US008066509B2

(12) United States Patent
Eroglu et al.

(10) Patent No.: US 8,066,509 B2
(45) Date of Patent: Nov. 29, 2011

(54) METHOD AND DEVICE FOR COMBUSTING HYDROGEN IN A PREMIX BURNER

(75) Inventors: Adnan Eroglu, Untersiggenthal (CH); Klaus Döbbeling, Windisch (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 12/785,253

(22) Filed: May 21, 2010

(65) Prior Publication Data

US 2010/0266970 A1 Oct. 21, 2010

Related U.S. Application Data

(63) Continuation of application No. PCT/EP2008/065107, filed on Nov. 7, 2008.

(30) Foreign Application Priority Data

Nov. 27, 2007 (CH) ..... 1837/07

(51) Int. Cl.
*F23C 7/00* (2006.01)
*F23D 11/40* (2006.01)
*F23R 3/28* (2006.01)

(52) U.S. Cl. ..... 431/350; 431/8; 431/9; 431/10

(58) Field of Classification Search ..... 431/350, 431/353, 8, 9, 10; 60/722, 733, 737, 738
See application file for complete search history.

(56) References Cited

U.S. PATENT DOCUMENTS 2,647,568 A * 8/1953 Sloan ..... 431/183
4,604,050 A * 8/1986 Henriksson ..... 431/121
4,932,861 A 6/1990 Keller et al.
5,375,995 A * 12/1994 Dobbeling et al. ..... 431/8
5,482,457 A * 1/1996 Aigner et al. ..... 431/351
5,588,826 A * 12/1996 Dobbeling et al. ..... 431/354
5,626,017 A * 5/1997 Sattelmayer ..... 60/723
5,645,410 A * 7/1997 Brostmeyer ..... 431/10
5,735,687 A 4/1998 Knopfel et al.
5,791,894 A 8/1998 Dobbeling et al.
5,833,451 A * 11/1998 McMillan ..... 431/350
5,895,211 A * 4/1999 McMillan ..... 431/10
5,937,632 A * 8/1999 Dobbeling et al. ..... 60/777
6,126,439 A 10/2000 Knopfel et al.
6,152,726 A * 11/2000 Ruck et al. ..... 431/284

(Continued)

FOREIGN PATENT DOCUMENTS

DE 4409918 A1 * 9/1995

(Continued)

*Primary Examiner* — Carl Price
(74) *Attorney, Agent, or Firm* — Volple and Koenig P.C.

(57) ABSTRACT

A device for combusting fuel which contains or consists of hydrogen, is described, with a burner provided with a swirl generator and also a feeder for feeding fuel and a feeder for feeding combustion air into the swirl generator. A first feeder, for feeding liquid fuel along a burner axis, and a second feeder for feeding liquid fuel or gaseous fuel along air inlet slots which are tangentially delimited by the swirl generator, with a transition section connected downstream to the swirl generator, and with a mixer tube connected downstream to the transition section and with a changeable flow cross-sectional transition leads into a combustion chamber are provided. Along the transition section, a third feeder for feeding fuel which contains or consists of hydrogen, and also a fourth feeder for the selective feed of fuel which contains or consists of hydrogen, or of the gaseous fuel are also provided.

10 Claims, 6 Drawing Sheets

U.S. PATENT DOCUMENTS

| | | | | |
|---|---|---|---|---|
| 6,331,109 | B1 * | 12/2001 | Paikert et al. | 431/350 |
| 6,558,154 | B2 * | 5/2003 | Eroglu et al. | 431/8 |
| 7,003,957 | B2 * | 2/2006 | Griffin et al. | 60/737 |
| 7,137,809 | B2 * | 11/2006 | Bueche et al. | 431/12 |
| 7,140,183 | B2 * | 11/2006 | Ruck et al. | 60/737 |
| 7,445,445 | B2 * | 11/2008 | Eroglu et al. | 431/350 |
| 2007/0099142 | A1 * | 5/2007 | Flohr et al. | 431/354 |
| 2007/0259296 | A1 | 11/2007 | Knoepfel | |
| 2008/0280239 | A1 | 11/2008 | Carroni et al. | |
| 2009/0123882 | A1 * | 5/2009 | Eroglu et al. | 431/8 |

FOREIGN PATENT DOCUMENTS

| | | | | |
|---|---|---|---|---|
| DE | 10026122 | A1 | * | 11/2001 |
| EP | 0321809 | A1 | | 6/1989 |
| EP | 625673 | A2 | * | 11/1994 |
| EP | 0777081 | A2 | | 6/1997 |
| EP | 0780629 | A2 | | 6/1997 |
| EP | 0833105 | A2 | | 4/1998 |
| EP | 1070915 | A1 | | 1/2001 |
| GB | 2345958 | A | * | 7/2000 |
| JP | 09327641 | A | * | 12/1997 |
| WO | 9317279 | A1 | | 9/1993 |
| WO | WO 3036167 | A1 | * | 5/2003 |
| WO | 2005121648 | A1 | | 12/2005 |
| WO | 2006058843 | A | | 6/2006 |
| WO | 2006069861 | A1 | | 7/2006 |

* cited by examiner

METHOD AND DEVICE FOR COMBUSTING HYDROGEN IN A PREMIX BURNER

CROSS REFERENCE TO RELATED APPLICATIONS

This application is a continuation of International Application No. PCT/EP2008/065107 filed Nov. 7, 2008, which claims priority to Swiss Patent Application No. 01837/07, filed Nov. 27, 2007, the entire contents of all of which are incorporated by reference as if fully set forth.

FIELD OF INVENTION

The present invention refers to a burner for operating a premix combustion system with one or more fuels. It also refers to a method for operating such a burner.

Background

As a result of the almost global aim with regard to reducing greenhouse gases in the atmosphere, not least established in the so-called Kyoto Protocol, the emission of greenhouse gases which is to be expected in the year 2010 is to be reduced to the same level as in the year 1990. For implementing this plan, greater efforts are required especially for reducing the contribution of anthropogenically induced $CO_2$ releases. Approximately a third of the $CO_2$ which is released into the atmosphere by man is to be recycled for power generation, in which in most cases fossil fuels are combusted in power plants for electric power generation. Especially as a result of applying modern technologies, and also as a result of additional political framework conditions, in the power-generating sector a significant saving potential can be seen for avoiding a further increase of $CO_2$ emissions.

An as-known per se and technically controllable way of reducing the emission of $CO_2$ in combustion plants exists in the extraction of hydrocarbon from the fuels which are obtained for combustion before introducing the fuel into the combustion chamber. This requires corresponding fuel pretreatments, such as the partial oxidation of the fuel with oxygen and/or pretreatment of the fuel with steam. Fuels which are pretreated in such a way in most cases have a large portion of $H_2$ and CO, and, depending upon mixing ratios, have calorific values which as a rule lie below those of native natural gas. Depending upon their calorific value, gases which are synthetically produced in such a way are referred to as MBTU or LBTU gases which are not readily suitable for use in conventional burners which are designed for combusting gases, such as natural gas, as can be gathered for example from EP 0 321 809 B1, EP 0 780 629 A2, WO 93/17279 and also from EP 1 070 915 A1. These publications all form an integrating element of the present description. In all the previous publications, burners of the fuel premixing type are described, in which a swirled flow consisting of combustion air and admixed fuel, which conically widens in the flow direction, is produced in each case, which flow, after exiting from the burner, as far as possible after achieving a homogeneous air-fuel mixture, becomes unstable in the flow direction as a result of the increasing swirl and changes into an annular swirled flow with backflow in the core. Purely according to the device, the possibility also exists of providing a cylindrical or virtually cylindrical tube in which the air flows via longitudinal slots into the inside of the tube, wherein for maximizing the intended premixing the desired swirl formation of the air is provided with a fuel, which is injected at a suitable point, by means of a conically extending inner body, wherein this inner body features the conical tapering in the flow direction, as results for example from EP-0 777 081 A1. Also, this type of construction forms an integrating element of the present description.

Depending upon the burner concept, and also in dependence upon the burner capacity, the swirled flow of liquid and/or gaseous fuel, which is formed inside the premix burner, is fed for forming a fuel-air mixture which is as homogeneous as possible. If it is necessary, however, as previously mentioned, to use synthetically processed gaseous fuels alternatively to, or in combination with, the combusting of conventional fuel types for the purpose of reduced emission of pollutants, especially emission of $CO_2$, then special requirements arise for the constructional design of conventional premix burner systems. Therefore, for feeding into burner systems synthesis gases require a multiple fuel volumetric flow in comparison to comparable burners which are operated with natural gas so that considerably different flow impulse ratios result. On account of the high portion of hydrogen in the synthesis gas and the low ignition temperature and high flame velocity of the hydrogen associated therewith, a high reaction tendency of the fuel exists which leads to an increased risk of flashback. In order to avoid this, it is necessary to reduce, as much as possible, the average residence time of ignitable fuel-air mixture inside the burner.

In WO 2006/058843 A1, a method and also a burner for combusting gaseous fuel, liquid fuel and also fuel which contains hydrogen, or consists of hydrogen, subsequently referred to as synthesis gas, are described. In this case, a double-cone burner with a mixing section connected downstream according to EP 0 780 629 A2 is used, which is schematically shown in FIGS. 2*a* and *b* in longitudinal sectional view. The premix burner arrangement makes provision for a conically widening swirl generator 1 which is defined by swirl shells 2. Means for feeding fuel are provided axially and also coaxially around the center axis A of the swirl generator 1. In this way, liquid fuel $B_{fl}$ reaches the swirl chamber by means of an injection nozzle 3 which is positioned along the burner axis A at the place of the smallest inside diameter of the swirl generator 1. Along tangential air inlet slots 4, via which combustion air L enters the swirl chamber with tangential flow direction, gaseous fuel $B_g$, preferably natural gas, is admixed with the combustion air L. Provision is additionally made for injection devices 5 (see FIG. 2*b*) which serve for the further feeding of synthesis gas $B_{H2}$ which contains hydrogen.

By means of a transition section 6, in which provision is made for the flow means 7 which stabilize the swirled flow, the fuel-air mixture, which is formed inside the swirl generator 1, in the form of a swirled flow reaches a mixer tube 8 along which a completely homogeneous intermixing of the formed fuel-air mixture is carried out, before the ignitable fuel-air mixture is ignited inside a combustion chamber B which is connected downstream to the mixer tube 8. On account of a varying increase of flow cross section in the transition from the mixer tube 8 to the combustion chamber B, the swirled flow of the intermixed fuel-air mixture breaks down, forming a backflow zone in the form of a backflow bubble RB in which a spatially stable flame front is established.

In the region of the mixer tube 8, the axial flow velocity distribution of the swirled flow, which propagates axially along the mixer tube 8, is shown in FIG. 2*a*. It shows that the flow velocity is at its maximum close to the axis and lies typically three to four times above the velocity level in the region of the mixer tube wall. Without further measures, this leads to the formation of a vortex layer close to the wall in which excessive fuel concentrations can accumulate inside stationary vortices which again lead to flashback in the region of the mixer tube. There is also the fact that an axial or coaxial feed of synthesis gas which contains hydrogen, as is the case in the previously quoted publication, results in an increased temperature distribution close to the axis, which is ultimately partly the cause of increased nitrogen oxide emission values.

Summary

The disclosure is directed to a burner for operating a premix combustion system with one or more fuels. The burner includes a swirl generator on a head side, a feeder for feeding a fuel and a feeder for introducing combustion air into the swirl generator. A first feeder for feeding a liquid fuel and/or a gaseous fuel along a burner axis and a second feeder for feeding liquid fuel and/or gaseous fuel along air inlet slots which are tangentially delimited by the swirl generator are provided. Downstream of the swirl generator the burner has a directly connected transition section and a mixer tube which is connected downstream to the transition section, the mixer tube, with a changeable flow cross-sectional transition, leading into a combustion chamber. A third feeder is provided along the transition section and/or downstream of the transition section for feeding the fuel which contains hydrogen, or consists of hydrogen. A fourth feeder is also provided for feeding the fuel which contains hydrogen, or consists of hydrogen, and/or a further gaseous fuel.

The disclosure is directed, in another embodiment, to a method for operating a burner for a premix combustion system with one or more fuels. The burner includes a swirl generator on a head side, with a feeder for feeding a fuel and a feeder for introducing combustion air into the swirl generator. The method includes providing a first feeder to ensure the feed of a liquid fuel and/or of a gaseous fuel along a burner axis (A). The method also includes providing a second feeder to ensure the feed of liquid fuel and/or of gaseous fuel along air inlet slots which are and/or a further gaseous fuel.

BRIEF DESCRIPTION OF THE DRAWINGS

The invention is exemplarily described below, without limitation of the general inventive idea, based on exemplary embodiments with reference to the drawings. In the drawings.

DETAILED DESCRIPTION OF THE PREFERRED EMBODIMENTS

Introduction to the Embodiments

The invention is based on the object of developing a device for combusting fuel which contains hydrogen, or consists of hydrogen, with a burner of the previously referred to type, in a way in which improved combustion results are to be obtained with regard to reduced nitrogen oxide emission values, but especially also with regard to a considerably reduced risk of flashback. In particular, it shall be possible to make the premix burner accessible to an efficient burner operation which enables the combustion both of natural gas, crude oil and of synthesis gases, i.e. fuels which contain hydrogen or consist of hydrogen.

The achieving of the object upon which the invention is based is disclosed in claims 1 and 9. Features which advantageously develop the inventive idea are the subject of the dependent claims and are also to be gathered from the further description with reference to the exemplary embodiments. Attention should expressly be made to the fact that the content of all the claims counts towards the overall disclosure content of the description.

According to the solution, in a device for combusting fuel which contains hydrogen, or consists of hydrogen, subsequently referred to as synthesis gas, along the transition section, provision is made for a third feeder for feeding synthesis gas and also a fourth feeder for selective feeding of the synthesis gas or of the gaseous fuel, preferably in the form of natural gas.

Figure 2A:
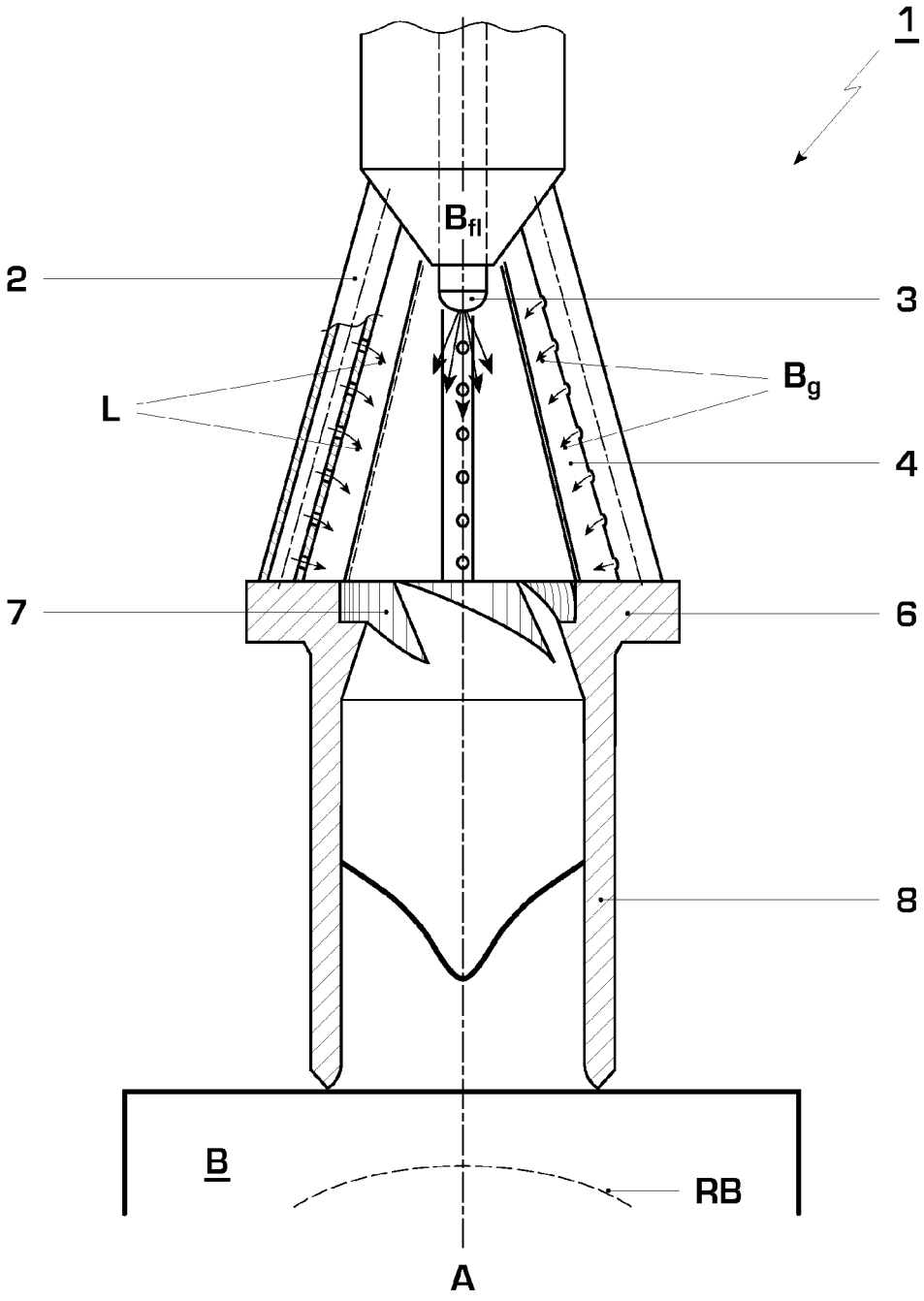

By providing two separate feed possibilities of both synthesis gas and natural gas along the transition section between the swirl generator and the mixer tube, an exceedingly high degree of flexibility is opened up for the burner concept of a premix burner with regard to the operation with different fuels and fuel combinations. A premix burner which is modified in such a way according to the solution can be operated individually in a staged manner with different fuel feeds, not least in dependence upon the burner load, wherein in a particularly advantageous manner the inherently critical characteristics with regard to combusting synthesis gases can be advantageously utilized by the directed feed along the transition section. In this way, a feed of the synthesis gas, which is as close to the wall as possible, in the region of the transition section contributes towards increasing the flow velocity profile close to the wall, especially in the region of the mixer tube, and towards decisively flattening the considerable increase of flow velocity along the burner axis which is shown in FIG. 2*a*, as a result of which a smaller flow vortex formation close to the wall is advantageously established and the risk of flashback which is associated therewith is reduced. Further, the synthesis gas, which is very much lighter in comparison to the swirled flow which propagates axially inside the burner, is able to intermix more easily in the direction of the radially inner flow regions so that before entry into the combustion chamber, which is connected downstream to the mixer tube, a completely intermixed fuel-air mixture can be formed. As a result of the centrifugal force-assisted intermixing of the synthesis gas, which is lighter in comparison to the air portions inside the swirled flow, it is possible to carry out the feed of synthesis gas into the swirled flow, which propagates axially inside the burner, with only small radial entry angles without noticeably impairing or irritating the swirled flow in its flow behavior in the process.

In the same way, it is necessary to carry out the feed of natural gas inside the transition section, i.e. the flow direction and the flow impulse from the discharge openings, which are provided for the feed of natural gas, into the region of the transition section are adapted to the local flow conditions of the swirled flow which is formed inside the burner without unduly irritating these in the process. Therefore, the feed of natural gas is also carried out with a radial component relative to the burner axis in order to maintain an intermixing of the fed natural gas, which is as effective and homogeneous as possible, with the axially propagating swirled flow.

On account of the different physical properties with regard to density, calorific value characteristics and ignition behavior, the discharge openings, through which the fuel which features the synthesis gas, i.e. the hydrogen, is discharged, are to be dimensioned larger than the discharge openings through which the natural gas is customarily discharged in the region of the transition section. Also, the radial component with which the respective fuels are fed into the inside of the burner in the region of the transition section is to be individually set in the light of an intermixing which is as quick and efficient as possible and at the same time taking into consideration an irritation which is as insignificant as possible of the swirled flow which propagates inside the burner. With regard to a flow irritation of the swirled flow which is as little as possible, a radial angle, which is included by the fuel delivery direction of the synthesis gas and the burner axis, is to be selected larger than that radial angle with which the natural gas is discharged in the region of the transition section, particularly as the natural gas has a higher flow impulse and is able to more noticeably impair the swirled flow.

A preferred embodiment variant makes provision in each case for discharge openings, which are arranged in a circularly equally distributed manner in the transition section, through which openings the synthesis gas is discharged into the inside of the burner. All the discharge openings are connected to a common reservoir volume which preferably encompasses the transition section in a circular manner and is fed with synthesis gas via a supply line. Separately to this, provision is made for a further multiplicity of discharge openings along the transition section, also circularly equally distributed in a similar manner, via which the gaseous fuel, preferably natural gas, is delivered. Also, the second group of discharge openings is connected in each case with a standardized reservoir volume which is fed with natural gas via a separate supply line. Along the respective supply lines provision is preferably made for restrictor valves via which a metered and controlled respective fuel feed via the corresponding discharge openings is possible.

An especially preferred embodiment makes provision along the supply line, via which natural gas is fed in the normal case, for a three-way valve which enables the possibility of an alternative feed either of natural gas or of synthesis gas. By such a three-way valve it is therefore possible to discharge synthesis gases via all the discharge openings which are provided inside the transition section.

In order to prevent the respective fuel feeds being mutually non-sustainably influenced, for example by natural gas penetrating into the region of the discharge openings through which synthesis gases are discharged, or vice versa, in the case of a mixed operation, i.e. in the case of simultaneous feed both of synthesis gas and of natural gas, the discharge openings of the respective fuel types are arranged in a circularly offset manner in relation to each other. The discharge openings, through which natural gas is discharged, can preferably be arranged downstream of the discharge openings through which synthesis gas is discharged. Further details with regard to arrangement and design of a transition section which is formed according to the solution are to be gathered from the further description with reference to the exemplary embodiments.

DETAILED DESCRIPTION

Figure 1:
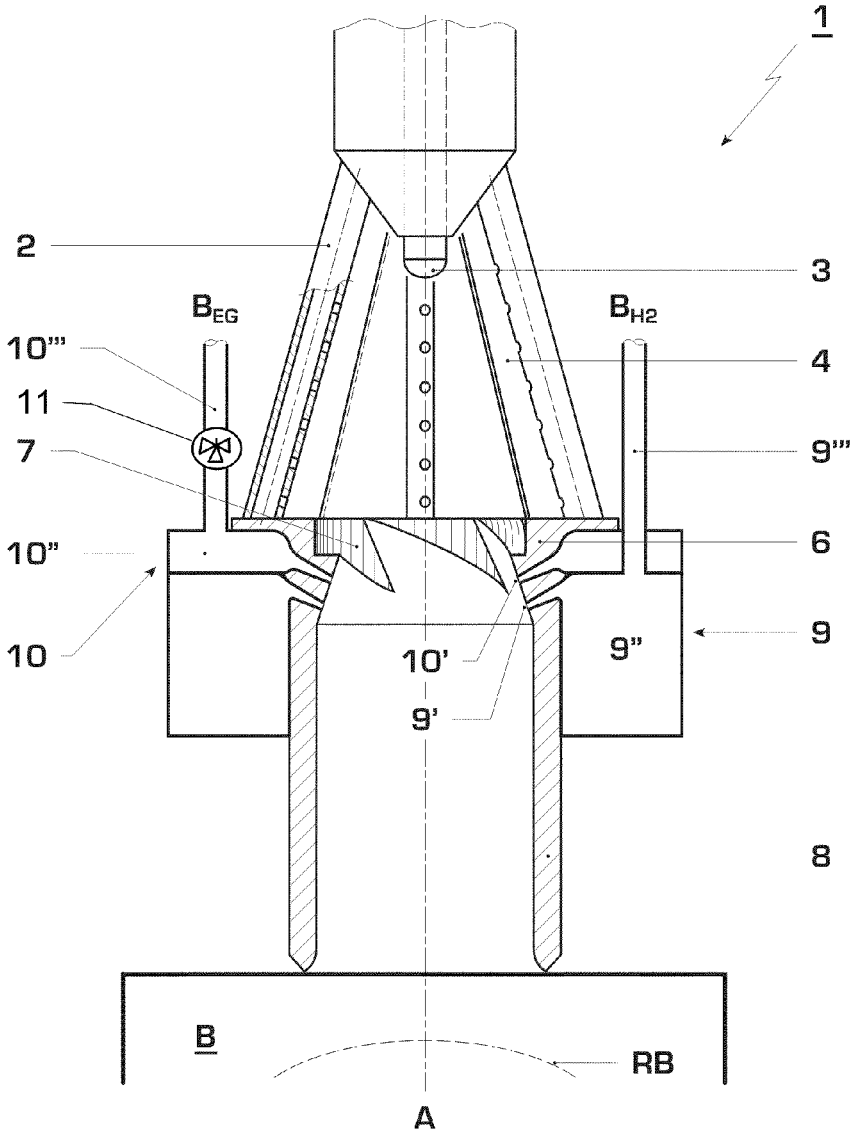
FIG. 1 shows a longitudinal section through a premix burner which is formed according to the solution, FIGS. 2*a, b* show longitudinal sections through a premix burner according to the prior art.

In FIG. 1, a premix burner arrangement which is formed according to the solution is shown in a longitudinal sectional view. With regard to the components of the premix burner arrangement already described with reference to FIGS. 2*a* and *b*, reference is especially made to the fact that the designations which are drawn in in FIG. 1 are identical to those in FIGS. 2*a* and *b*, in order to avoid repetitions. According to the solution, provision is made in the region of the transition section 6 for two separate feeders 9, 10 for feeding fuel into the region of the mixing section which is connected to the transition section 6 and encompassed by the mixer tube 8. Therefore, the feeder 9 has a multiplicity of discharge openings 9' which are circularly equally distributed inside the transition section 6 and all of which are connected via individual feed passages to a reservoir volume 9" which peripherally encompasses the transition section 6 and in turn is supplied via a supply line 9'" with fuel $B_{H2}$ which contains hydrogen, or consists of hydrogen. Separately from this, the feeder 10 also has discharge openings 10' which are circularly equally distributed inside the transition section 6 and connected via connecting passages to a reservoir volume 10" which also peripherally encompasses the transition section 6 and is supplied preferably with natural gas $B_{EG}$ via a supply line 10'".

Figure 2B:
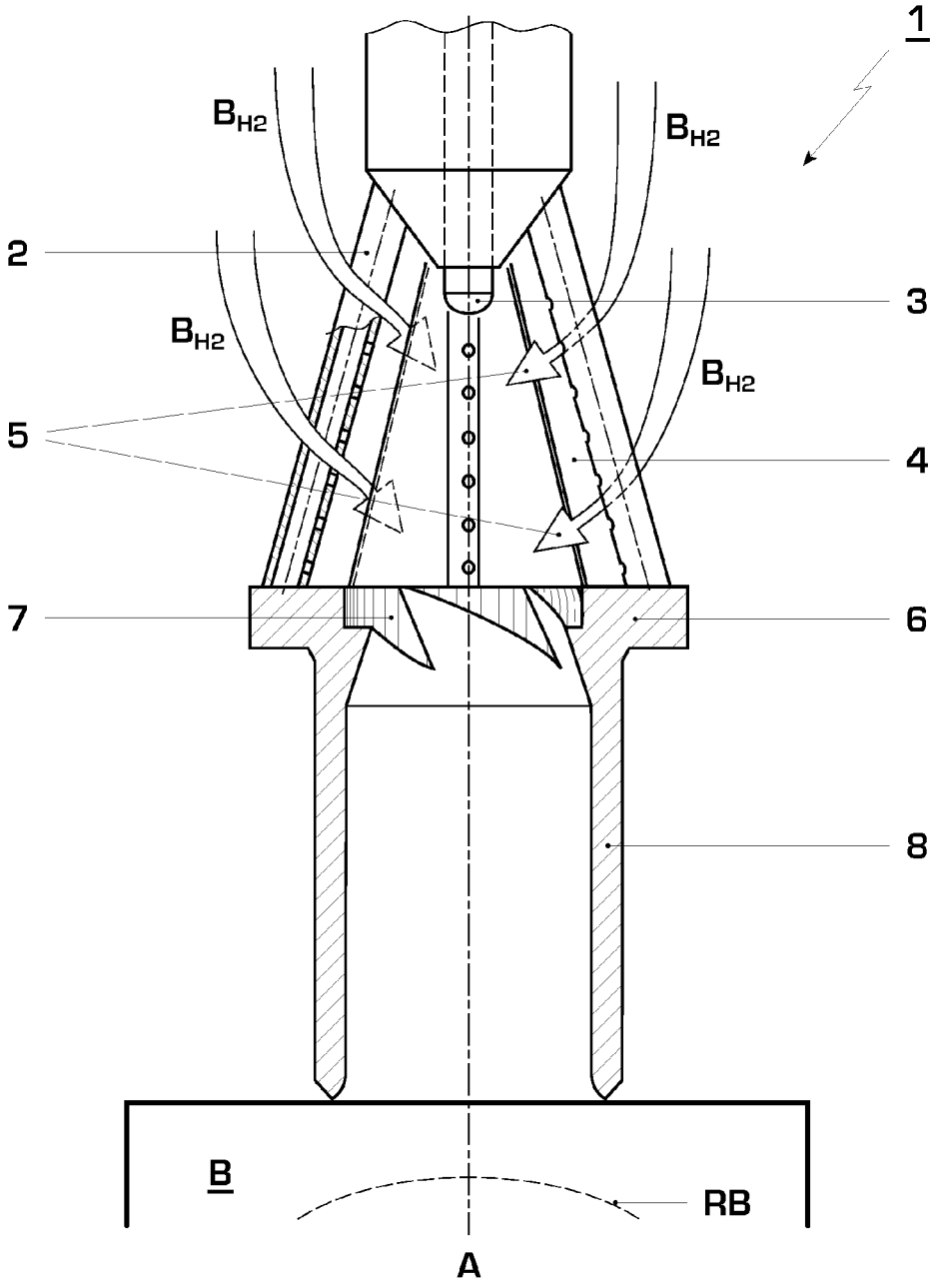

It is apparent from the longitudinal sectional view according to FIG. 2 that the discharge openings 9' for delivery of synthesis gas are dimensioned larger than those discharge openings 10' through which the delivery of natural gas is carried out. Along the individual supply lines 9'" and 10'" provision is made for corresponding restrictor valves (not shown), through which the fuel feed can be individually adjusted.

In contrast to the longitudinal sectional view which is shown in FIG. 2, which is only to reproduce a rough schematic diagram of a premix burner arrangement, the discharge openings 9' and 10' are arranged in a circularly offset manner in relation to each other so that a negative mutual influencing of the introduction of fuel is to be excluded. Therefore, it is necessary to avoid natural gas being introduced into the openings 9' through which synthesis gas is discharged, and vice versa. It is also advisable to arrange the natural gas discharge openings 10' downstream of those discharge openings 9' through which synthesis gas is delivered.

Figure 3:
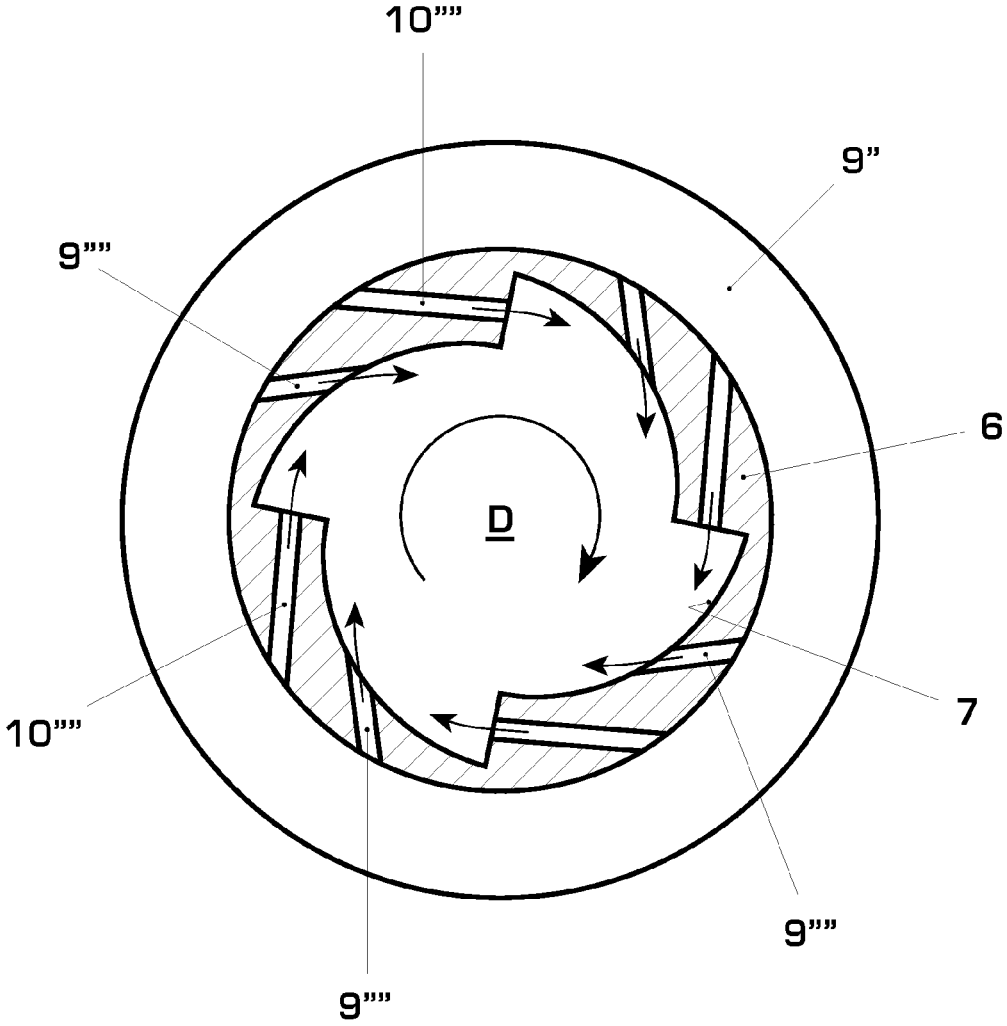
FIG. 3 shows a cross section through the transition section of a premix burner which is formed according to the solution.

According to the cross-sectional view through the transition section 6 which is shown in FIG. 3, it can be gathered that both the natural gas and the synthesis gas can be fed separately from each other through corresponding discharge openings 9', 10' into the interior of the swirled flow D with a corresponding radial component. The delivery of fuel is carried out with regard to the spatial adjustment of the fuel discharge and also with regard to the flow velocity with which the fuel is discharged, with consideration for a disturbance of the swirled flow D which is as minimal as possible and also for an intermixing which is as optimal as possible of the discharged fuel with the swirled flow. In FIG. 3, the transition section 6 is encompassed by the reservoir volume 9" which is filled with synthesis gas $B_{H2}$. Via the feed passages 9"" which penetrate the transition section 6 the synthesis gas $B_{H2}$ reaches the region of the swirled flow D without substantially irritating the flow characteristic of the swirled flow D in the process.

For better understanding, the feed passages 10"" for the feed of natural gas are likewise also drawn in in the cross-sectional view according to FIG. 3. The arrangement of the individual passages illustrates that a feed of the respective fuel types is carried out without influencing and hindering the respective other fuel type. In this way, for example introduced natural gas being able to reach the feed passages 9"" can be excluded, even in the case when no synthesis gas is discharged. In this case, it essentially concerns avoiding or reducing the risk of combustion and risk of overheating empty fuel lines.

Figure 4:
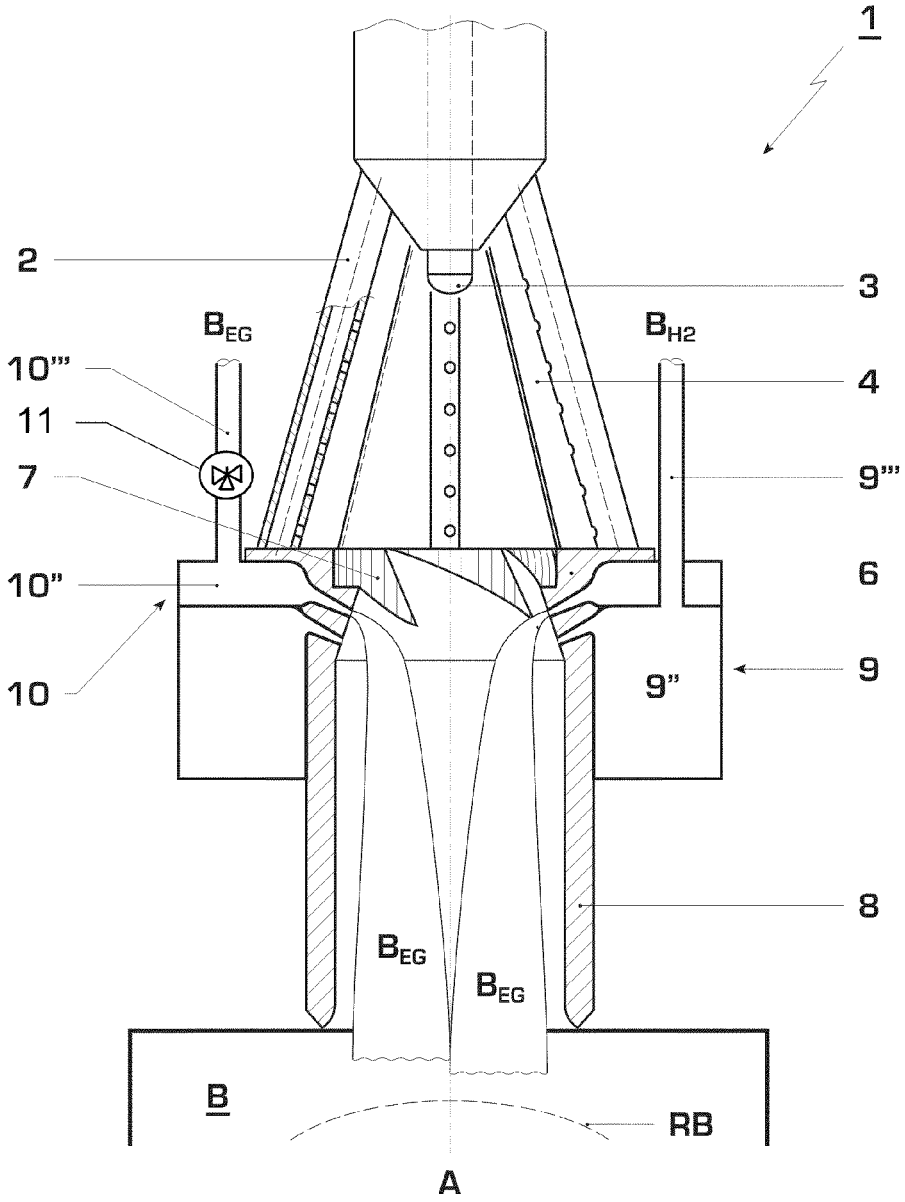
FIGS. 4 and 5 show longitudinal sectional views through premix burners, which are formed according to the solution, in different modes of operation.
Figure 5:
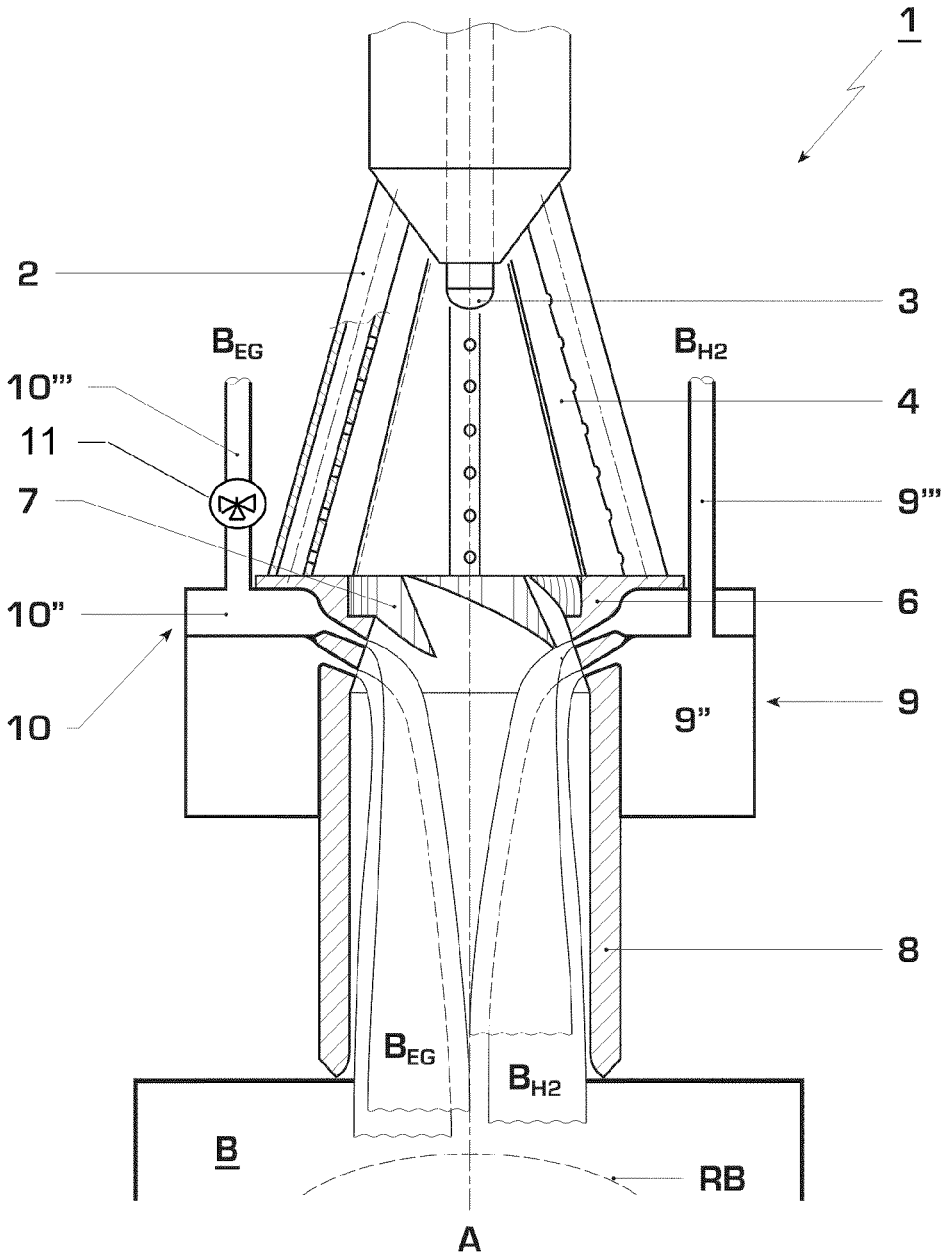

In FIG. 4, a longitudinal sectional view through a premix burner which is formed according to the solution is shown, in which only one feed of natural gas is carried out via the discharge openings 10'. It may be assumed that a restrictor unit, which is not additionally shown and provided along the supply line 9''', is closed. In contrast, a mode of operation is shown in the figure representation according to FIG. 5 in which synthesis gas is fed both via the discharge openings 9' and 10' into the swirled flow. In this case, provision is made along the supply line 10''' for a three-way valve 11 via which an alternative filling of the reservoir volume 10' either with natural gas or with synthesis gas is possible. In the case of FIG. 5, the reservoir volume 10' is therefore also filled with synthesis gas so that a double synthesis gas admixing with the swirled flow which is formed inside the burner arrangement results.

With reference to the flow regions of the respectively fed fuels $B_{H2}$ and also $B_{EG}$, which can be gathered from FIGS. 4 and 5, it is apparent that the delivered fuel neither clings along the inner wall of the transition section or of the mixer tube directly downstream of the respective feed point, nor accumulates in the center along the burner axis A. Therefore, the fuels are introduced in each case with sufficient radial component into the interior of the axially propagating swirled flow, on the one hand in order to irritate the swirled flow as little as possible, but on the other hand in order to avoid a direct wall contact. The intermixing of the introduced synthesis gas or correspondingly of the introduced natural gas across the entire flow cross section is achieved just before reaching the transition of the mixer tube into the combustion chamber, as can be gathered from FIGS. 4 and 5.

The measures according to the solution help the burner arrangement towards the following advantages:

The mode of operation of a staged feed of synthesis gas inside the region of the transition section, this being the case if the two fuel feeders which are provided along the transition section are controlled and supplied with synthesis gas in a metered manner, opens up the possibility of adjusting the fuel ratio between two settings with regard to an optimization in respect to emission and combustion chamber pulsations which occur, and also in respect to flashback characteristics.

The measure according to the solution, on account of its high integration capability, solves a problem of space, which always exists in burner construction, by the natural gas feeder also being able to be used for the extended feed of synthesis gas in addition to using it for feeding natural gas.

The risk of flashback can be appreciably reduced by the measure according to the invention, particularly as a fuel accumulation both close to the wall and along the burner axis can be avoided by corresponding adjustment of the fuel inlet characteristics.

As a result of feeding synthesis with high flow velocity along the wall regions the risk of flashback can also be reduced.

In addition, feeding synthesis gas along the transition section helps in reducing nitrogen oxide emissions, particularly as the synthesis gas, on account of its lighter weight, is homogeneously distributed comparatively quickly along the entire flow cross section counter to the centrifugal forces which act in the swirled flow.

Since the transition section is formed as a simple and robust component, fuel feed passages therein, and also fuel reservoirs which are to be connected thereto, can be easily and simply realized.

The burner arrangement according to the solution offers a maximum of variability with regard to operation of a burner with different fuel types and also their combinations.

As a result of a clever arrangement of the respective discharge openings along the transition section, a corresponding purging of the discharge openings with air can be dispensed with.

As a result of feeding natural gas and/or synthesis gas along the transition section, shorter residence times especially of hydrogen inside the burner are incorporated. As a result of this, the burner can be operated more reliably and the risk of flashback is considerably reduced because of this.

LIST OF DESIGNATIONS

1 Swirl generator
2 Swirl cone shells
3 Injection nozzle
4 Air inlet slot
5 Synthesis gas feeds
6 Transition section
7 Flow guide
8 Mixer tube
9 Synthesis gas feeder
9' Discharge opening
9'' Synthesis gas reservoir
9''' Supply line
9'''' Feed passage
10 Natural gas feeder
10' Discharge opening
10'' Reservoir for natural gas
10''' Supply line for natural gas
10'''' Feed passage
11 Three-way valve
A Burner axis
B Combustion chamber
RB Backflow bubble, backflow zone
$B_{EG}$ Natural gas
$B_{H2}$ Synthesis gas
$B_g$ Gaseous fuel
$B_{fl}$ Liquid fuel
D Swirled flow
L Combustion air

What is claimed is:

1. A burner for operating a premix combustion system with one or more fuels, wherein the burner comprises a swirl generator (1) on a head side, a fuel feeder for feeding a fuel and a combustion air feeder for introducing combustion air (L) into the swirl generator (1), the fuel feeder comprising a first feeder (3), for feeding a liquid fuel (Bfl) and/or a gaseous fuel (Bg) along a burner axis (A), and a second feeder for feeding liquid fuel (Bfl) and/or gaseous fuel (Bg) along air inlet slots (4), which are tangentially delimited by the swirl generator (1), and are provided, downstream of the swirl generator (1), the burner further comprises a directly connected transition section (6) and a mixer tube (8), which is connected downstream to the transition section (6), the mixer tube (8) leads into a combustion chamber (B), the fuel feeder further comprising a third feeder (9) provided along the transition section (6) and/or downstream of the transition section (6) for feeding fuel which contains hydrogen, or consists of hydrogen, and a fourth feeder(10) for feeding fuel which contains hydrogen, or consists of hydrogen, and/or a further gaseous fuel, the third (9) and fourth (10) feeders each comprise a multiplicity of discharge openings (9', 10'), which are arranged and oriented, relative to each other, along the transition section (6) in such a way that over flowing of the third feeder (9) discharge openings (9') by fuel that is discharged from the fourth feeder (10) does not occur.

2. The device as claimed in claim 1, wherein the third multiplicity of individual discharge openings (9') of the third feeder (9) are arranged in a circularly equally distributed manner in the transition section (6), from which the fuel which contains hydrogen, or consists of hydrogen, can be fed, and the multiplicity of individual discharge openings (10') of the fourth feeder (10) are arranged in a circularly equally distributed manner in the transition section (6), from which the fuel which contains hydrogen, or consists of hydrogen, or the gaseous fuel, can be selectively fed.

3. The device as claimed in claim 1, wherein the third and the fourth feeders (9, 10) can be supplied with the respective fuel separately from each other in each case via at least one supply line (9''', 10''').

4. The device as claimed in claim 3, wherein along the at least one supply line (10''), which supplies the fourth feeder (10) with fuel, a three-way valve is provided, to which are connected both a supply line for feeding the fuel which contains hydrogen, or consists of hydrogen, and a supply line for feeding the gaseous fuel.

5. The device as claimed in claim 1, wherein the discharge openings (9') of the third feeder (9) comprises a larger opening width than the discharge openings (10') of the fourth feeder (10).

6. The device as claimed in claim 1, wherein the gaseous fuel is natural gas.

7. The device as claimed in claim 1, wherein the discharge openings (10') of the fourth feeder (10) are arranged along the transition section (6) downstream of the discharge openings (9') of the third feeder (9).

8. The burner as claimed in claim 1, wherein the swirl generator (1) comprises at least two hollow partial cone shells which are nested inside each other in the flow direction, completing a body, the cross section of the interior space which is formed by the hollow partial cone shells increases in the flow direction, respective longitudinal symmetry axes of these partial cone shells extend in an offset manner in relation to each other in such a way that the adjacent walls of the partial cone shells form tangential slots or passages in their longitudinal extent for the inflow of combustion air into the interior space which is formed by the partial cone shells.

9. The burner as claimed in claim 1, wherein the swirl generator comprises at least two hollow partial shells which are nested inside each other in the flow direction, completing a body, the cross section of the interior space which is formed by the hollow partial shells extends in a cylindrical or virtually cylindrical manner in the flow direction, respective longitudinal symmetry axes of these partial shells extend in an offset manner in relation to each other in such a way that the adjacent walls of the partial shells form tangential slots or passages in their longitudinal extent for the inflow of combustion air into the interior space which is formed by the partial shells, and in that the interior space has an inner body, the cross section of which decreases in the flow direction.

10. The burner as claimed in claim 9, wherein the inner body extends in a conical or essentially conical manner in the flow direction.

* * * * *

UNITED STATES PATENT AND TRADEMARK OFFICE

CERTIFICATE OF CORRECTION

PATENT NO. : 8,066,509 B2
APPLICATION NO. : 12/785253
DATED : November 29, 2011
INVENTOR(S) : Adnan Eroglu et al.

It is certified that error appears in the above-identified patent and that said Letters Patent is hereby corrected as shown below:

IN THE CLAIMS

In claim 4 (column 9, line 16), delete “supply line (10'')” and insert therefor --supply line (10''')--.

Signed and Sealed this
Twenty-first Day of February, 2012

David J. Kappos

David J. Kappos
*Director of the United States Patent and Trademark Office*